US006568881B2

(12) United States Patent
Long

(10) Patent No.: US 6,568,881 B2
(45) Date of Patent: May 27, 2003

(54) JET HEAD DEVICE FOR SINKING PILINGS

(76) Inventor: Walter Daniel Long, 2056 S. Shore Dr., Charleston, SC (US) 29407

( * ) Notice: Subject to any disclaimer, the term of this patent is extended or adjusted under 35 U.S.C. 154(b) by 0 days.

(21) Appl. No.: 09/977,846

(22) Filed: Oct. 15, 2001

(65) Prior Publication Data

US 2003/0072620 A1 Apr. 17, 2003

(51) Int. Cl.[7] ..... E21B 7/26; E02D 7/28

(52) U.S. Cl. ..... 405/248; 405/253; 405/255; 175/21; 175/57

(58) Field of Search ..... 405/232, 248, 405/253, 255; 175/19, 21, 57

(56) References Cited

U.S. PATENT DOCUMENTS

| | | | | | |
|---|---|---|---|---|---|
| 551,527 | A | | 12/1895 | Cunningham | 239/271 |
| 1,529,113 | A | * | 3/1925 | Burns | 405/248 |
| 1,879,414 | A | * | 9/1932 | Munoz | 405/253 |
| 1,937,172 | A | | 11/1933 | Starner et al. | 111/7.1 |
| 2,290,363 | A | | 7/1942 | Stirton | 222/282 |
| 2,763,222 | A | | 9/1956 | Herstedt | 111/7.3 |
| 2,993,650 | A | | 7/1961 | Badberg | 239/271 |
| 3,065,767 | A | | 11/1962 | Topf | 138/89 |
| 3,319,328 | A | | 5/1967 | Finger et al. | 29/423 |
| 3,514,959 | A | | 6/1970 | Dougherty, Jr. | 405/255 |
| 3,599,732 | A | * | 8/1971 | Kroon | 175/20 |
| 4,156,396 | A | | 5/1979 | Konucik | 111/7.1 |
| 4,161,090 | A | | 7/1979 | Watts, Jr. | 52/301 |
| 4,623,025 | A | * | 11/1986 | Verstraeten | 175/21 |
| 4,773,572 | A | | 9/1988 | Stull | 222/521 |
| 4,986,373 | A | * | 1/1991 | Charland et al. | 175/21 |
| 5,050,340 | A | | 9/1991 | Seifert | 47/48.5 |
| D350,385 | S | * | 9/1994 | Mitchell | D23/213 |
| D351,642 | S | * | 10/1994 | Mitchell | D23/213 |
| RE35,133 | E | * | 12/1995 | Halloran | 405/244 |
| 5,671,887 | A | | 9/1997 | Iavarone | 239/310 |
| 5,727,484 | A | | 3/1998 | Childs | 111/7.4 |
| 5,803,184 | A | * | 9/1998 | Van der Wouden | 175/21 |
| 5,803,672 | A | * | 9/1998 | Glass et al. | 405/232 |
| 5,961,253 | A | | 10/1999 | Okawa | 405/239 |
| 6,030,150 | A | * | 2/2000 | Schmednecht et al. | 405/243 |
| 6,173,931 | B1 | | 1/2001 | Johnson, Jr. et al. | 248/222.11 |
| 6,234,719 | B1 | | 5/2001 | Roynestad | 405/232 |
| 6,236,941 | B1 | | 5/2001 | Kram et al. | 702/12 |
| 6,308,454 | B1 | * | 10/2001 | Powell | 43/124 |

* cited by examiner

*Primary Examiner*—Robert E. Pezzuto
*Assistant Examiner*—Tara L. Mayo
(74) *Attorney, Agent, or Firm*—Kathleen M. Harleston; Harleston Law Firm, LLC

(57) ABSTRACT

A jetting device for installing a piling or post includes: (a) a cap including a generally conical or pyramidal shaped, perforated, hollow main body portion, and an upper flange portion for closely fitting over a base of the piling or post, the flange portion extending upward in a generally vertical direction from the main body portion; (b) attachment mechanism for attaching the flange portion of the cap to the base of the piling or post; and (c) a threaded fitting for receiving a detachable, generally vertical line for conducting a liquid or air into the cap, the fitting being in an upper section of the main body portion below the flange portion. Also included is a rectangular-shaped cap for a bulkhead section, and a method for installing a piling, post, or bulkhead.

22 Claims, 14 Drawing Sheets

JET HEAD DEVICE FOR SINKING PILINGS

CROSS REFERENCE TO RELATED DOCUMENT

This invention was described in Disclosure Disclosure Document Number 493884, which was stamped on May 21, 2001 by the U.S. Patent & Trademark Office.

BACKGROUND OF THE INVENTION

1. Technical Field

The present invention is a jetting device for installing pilings, posts, bulkheads, and the like, more particularly a conical, pyramidal, or pointed, rectangular shaped, hollow, perforated cap for placement over the base of the piling, post, or bulkhead, with at least one fitting for a detachable line for pumping air or liquid, such as water or flowable concrete, from a supply source down to the cap.

2. Background Information

This invention is a generally cone-shaped cap for the bottom ends of dock pilings, fence posts, bulk heads, housing stilts, manufactured and modular home tie down strips, bridge foundations, and the like. The pilings can be made of wood, concrete, steel, etc. The conical cap is made of a strong material, preferably a polyvinylchloride material, that is resistant to impact. A water flow source, preferably two inlet pipes, is connected to the perforated cap. When the water is turned on, it enters the cap through the inlet pipes and flows out from the cap from a central aperture at the bottom of the cap, and from the other, smaller apertures, while the piling or the like is being installed in the mud. The high pressure water facilitates the sinking of the pilings. This invention reduces the amount of installation time and construction noise. When the present invention is employed on the pilings of a dock, for example, the dock can be installed in less than half the time it would ordinarily take. Other liquids, such as cement for a foundation, can also be distributed via the cap.

BRIEF SUMMARY OF THE INVENTION

The present invention is a jetting device for installing a piling or post, comprising:

(a) a cap comprising a generally conical or pyramidal shaped main body portion, and an upper flange portion for closely fitting over a base of the piling or post, the flange portion extending upward in a generally vertical direction from the main body portion, the main body portion comprising a hollow interior and a plurality of perforations;

(b) attachment means for attaching the flange portion of the cap to the base of the piling or post; and (c) a threaded fitting for receiving a detachable, generally vertical line for conducting a liquid or air into the cap, the fitting being in an upper section of the main body portion below the flange portion.

The invention preferably also includes:

(d) at least one detachable line for conducting liquids or air, a lower end of the line being closely and removably connected to an upper portion of the main body portion, the line extending in a generally vertical direction generally parallel to the longitudinal axis of the piling or post; and (e) at least one pump for pumping the liquid or air up or down the line, the pump being coupled to an opposite, upper end of the line. A generally rectangular-shaped jet cap device for sinking a section of a bulkhead is also included herein.

Also included herein is a rectangular-shaped cap for installing a bulkhead section, and a method for installing a piling, post, or bulkhead using the cap.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein:

FIG. 5A is an alternate sectional side view of the jet device according to FIG. 4;

DETAILED DESCRIPTION OF THE INVENTION

Figure 1:
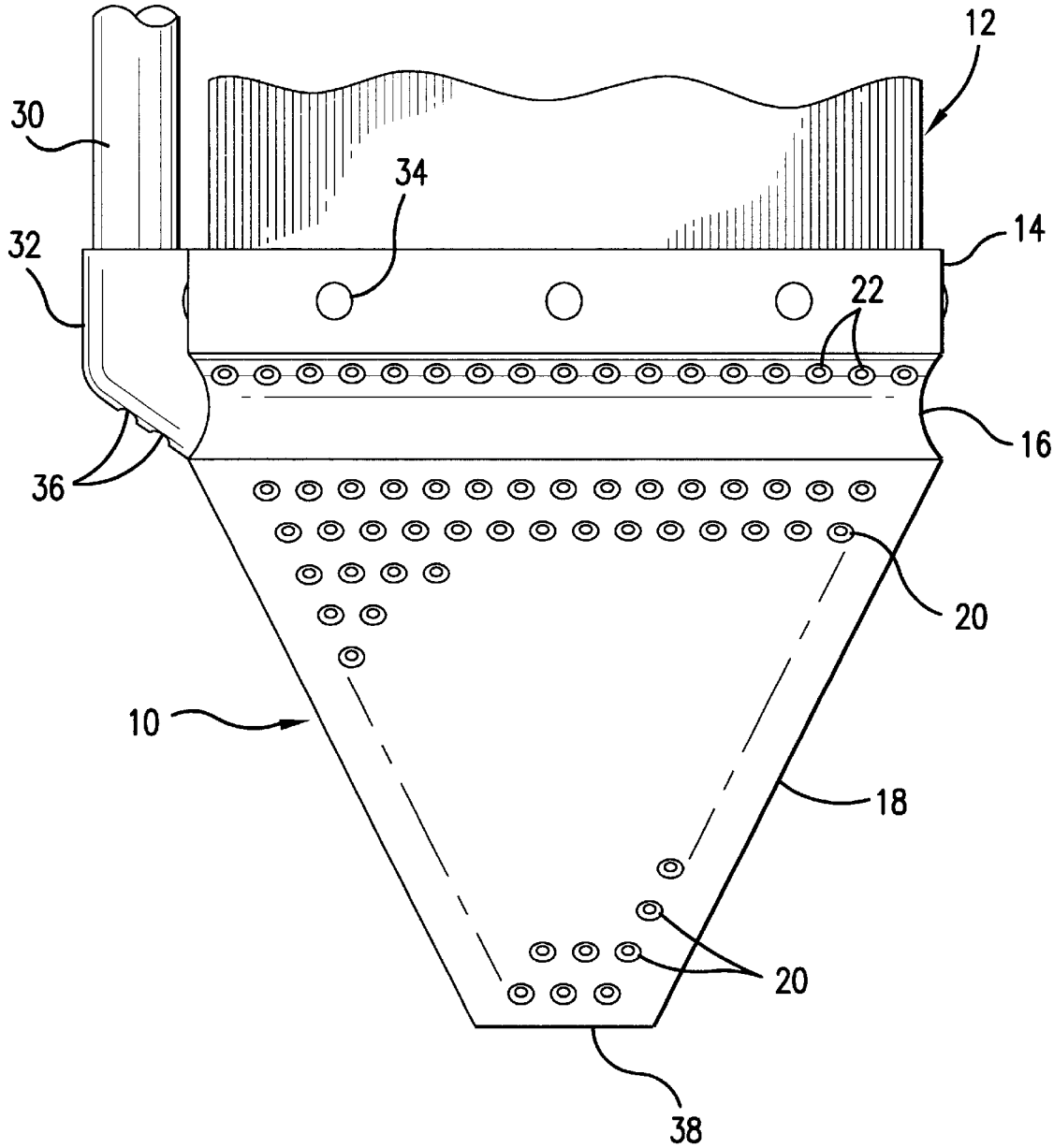
FIG. 1 shows a front elevational view of a jet device according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Figure 2:
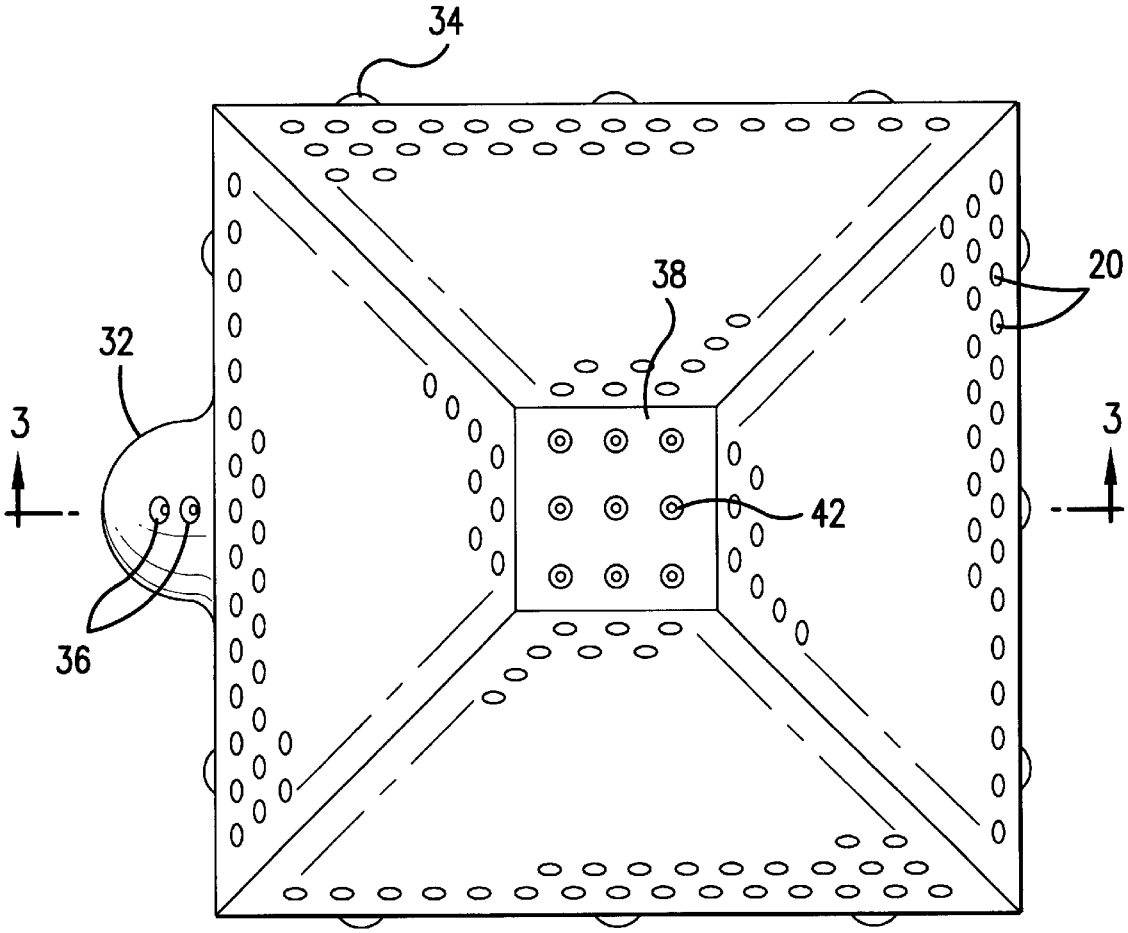
FIG. 2 is a bottom plan view of the jet device according to FIG. 1.
Figure 3:
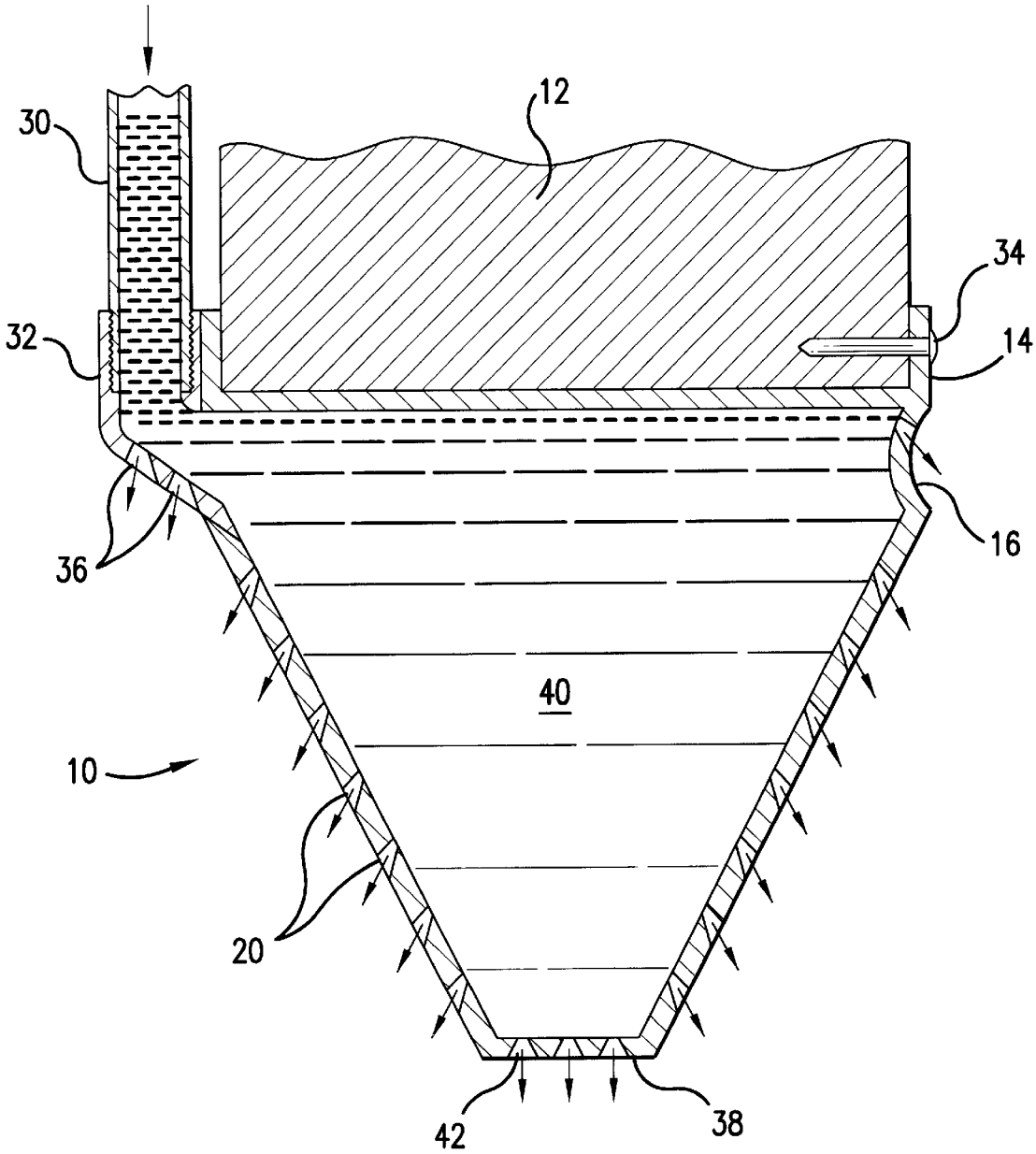
FIG. 3 is a sectional side view of the jet device according to FIG. 1.

Turning first to FIG. 1, FIG. 2, and FIG. 3, a jetting device, generally referred to as 10, according to the present invention is attached to one end of a piling 12 to be forced into the ground. The device 10, called here a "jet head", comprises: a) a cap comprising a generally conical or pyramidal shaped main body portion 18, and an upper flange portion 14 for closely fitting over a base of the piling 12 or post, the flange portion 14 extending upwardly in a generally vertical direction from the main body portion 18, the main body portion 18 comprising a hollow interior 40 and a plurality of perforations 20, 22; (b) attachment means 34 for attaching the flange portion 14 of the cap to the base of the piling or post; and (c) a threaded fitting 32 for receiving a detachable, generally vertical line 30 for conducting a liquid or air into the cap, the fitting 32 being in an upper section of the main body portion 18 below the flange portion 14.

Figure 13:
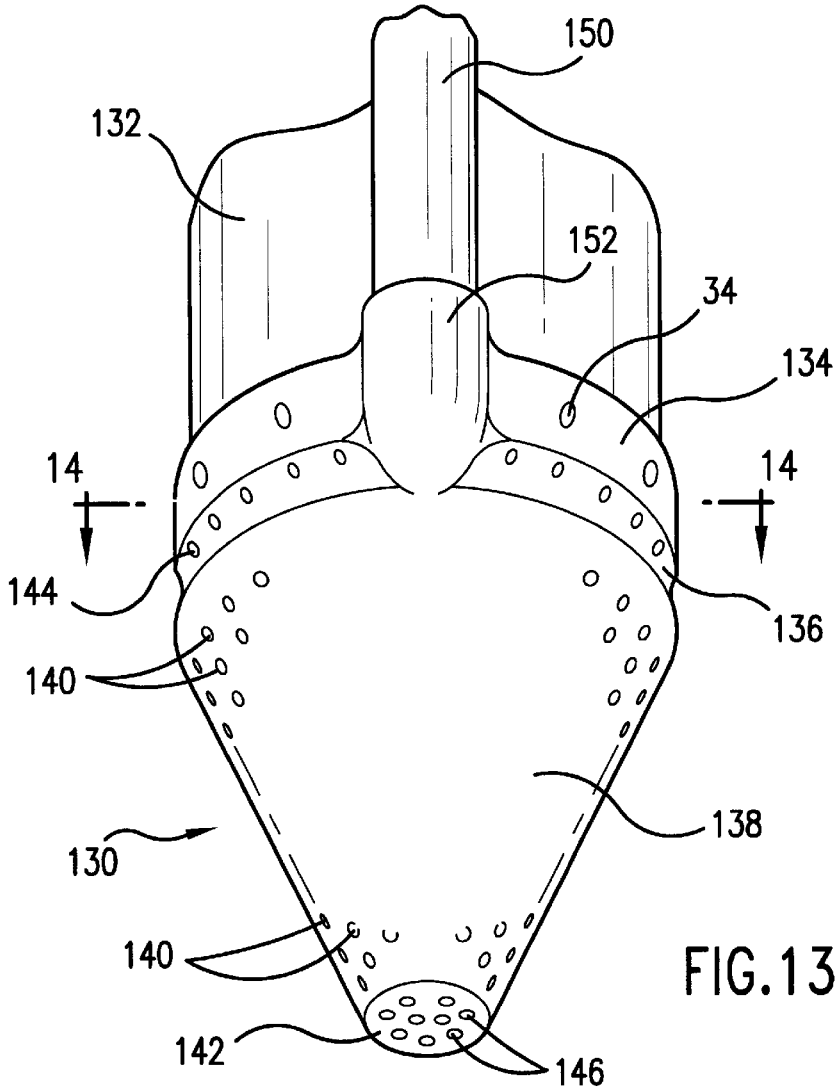
FIG. 13 is a front perspective view of an alternate embodiment of a jet device according to the present invention, for a circular piling.
Figure 14:
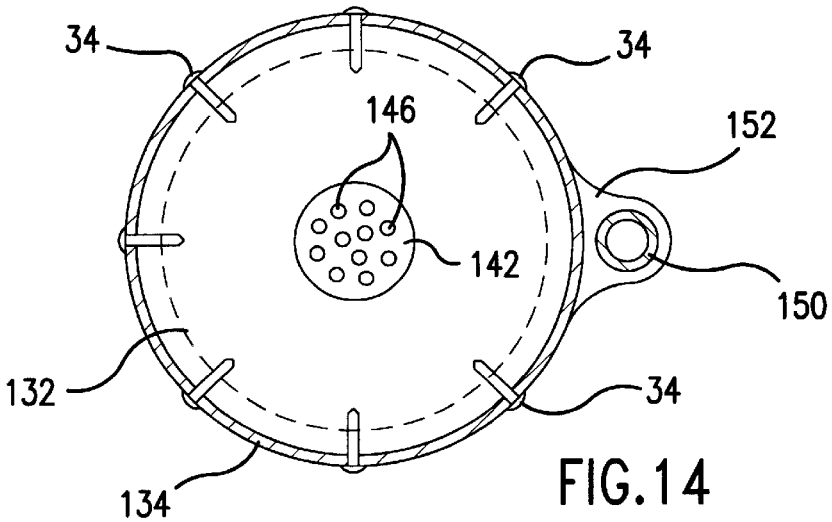
FIG. 14 is a top plan view of the jet device according to FIG. 13.

The cap basically has three portions. The first portion at the upper, wider end 13 of the cone-shaped or pyramid-shaped main body portion 18 is the flange portion 14, which fits around the bottom end, or base, of the piling 12 like a sleeve. It is affixed to the piling 12 by attachment means, preferably spaced-apart nails 34 or screws. The shape of the flange portion 14 varies according to the embodiment of the device 10, so that it conforms to the shape of the piling 12 or post. Thus, for a square post or piling 12, the flange portion 14 will be square in cross-section, as shown in FIG. 2, whereas with a circular post 132, the flange portion 134 will be cylindrical, as shown in FIG. 13 and FIG. 14.

In this preferred embodiment for light duty applications, such as pilings for home docks, the main body portion 18 is made of extrusion molded polyvinyl chloride (PVC). The main body portion includes an upper concave surface, or groove portion 16, around the upper section of the device 10. The groove portion 16 extends parallel and adjacent to the flange portion 14, the flange portion extending around the circumference of the piling 12 or post. The groove portion is preferably perforated with a series of evenly spaced, same-sized perforations 22. The device 10 is mounted on the piling 12 or post so that the base of the piling 12 stops just above the groove portion 14; thus the apertures 22 open into the hollow interior 40 of the device 10.

Third, the remainder of the hollow main body portion 18 lies below the groove portion 14 of the device 10. In the first embodiment shown in FIG. 1, FIG. 2, and FIG. 3, the main body portion 18 is generally pyramid-shaped with a square flange portion that fits over a square post-type piling 12. The main body portion ends in a nose 38, which is flat rather than sharpened to a point. It is understood that in the embodiments shown in FIG. 1 through FIG. 15, the particular shape of the main body portion 18 varies according to the shape of the post, piling, or bulkhead, and the particular application. In FIG. 1, FIG. 2, and FIG. 3, each side of the main body portion is perforated with numerous evenly spaced apertures 20. As shown in FIG. 2, the flattened nose 38 is also perforated with a series of evenly spaced apertures 42. The apertures 20, 22, 42 may be directional, that is, constructed at desired angles and depths to direct water in preferred directions for more effective use.

Referring still to FIG. 1, FIG. 2, and FIG. 3, a threaded end of a high pressure water line 30 is detachably attached to a correspondingly threaded, shouldered fitting 32, or elbow joint, which is built into the jetting device 10 along the groove portion 16. The lower end of the shouldered fitting 32 is molded or formed into the groove portion 16 at an upward angle of approximately 45 degrees, so that after the bend, the fitting 32 is oriented upward parallel to the piling 12, with the open end of the fitting 32 also facing upward to receive the line 30, which also extends down the length of the piling 12 parallel to the piling 12. In this preferred embodiment, the angled surface of the fitting 32 is perforated with two or more apertures 36. The line 30 opens to the hollow interior 40 of the main body portion 18.

With continued attention to FIG. 3, water or another flowable substance may be injected through the high-pressure line 30 through the fitting 32 and into the interior 40 of the device 10. The pressure from the line 30 forces the water through the apertures 20,22,36,42.

Figure 6:
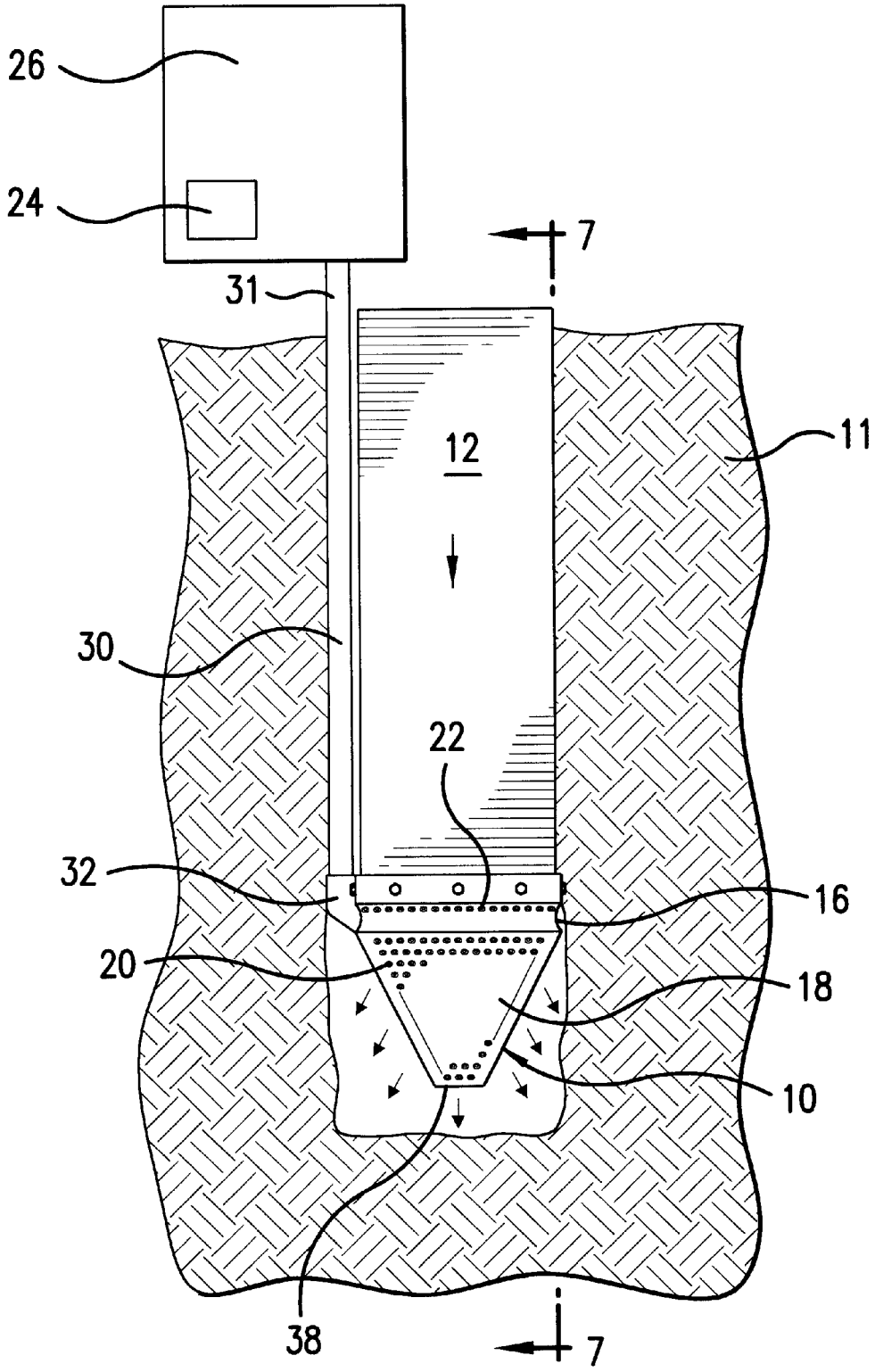
FIG. 6 is a front elevational view of the first embodiment of the jet device according to FIG. 1, shown in the ground.

As shown in FIG. 6, a preferred embodiment of the jetting device 10 preferably further comprises:

(d) at least one detachable line 30 for conducting liquids or air, a threaded lower end of the line being closely connectable to the correspondingly threaded fitting, the line 30 extending in a generally vertical direction generally parallel to the longitudinal axis of the piling 12 or post;

(e) at least one pump 24 for pumping the liquid or air up or down the line 30, the pump 24 being coupled to an opposite, upper end 31 of the line; and (f) at least one supply source 26 for the liquids, the liquid supply source being connected to the upper end 31 of the line.

Figure 7:
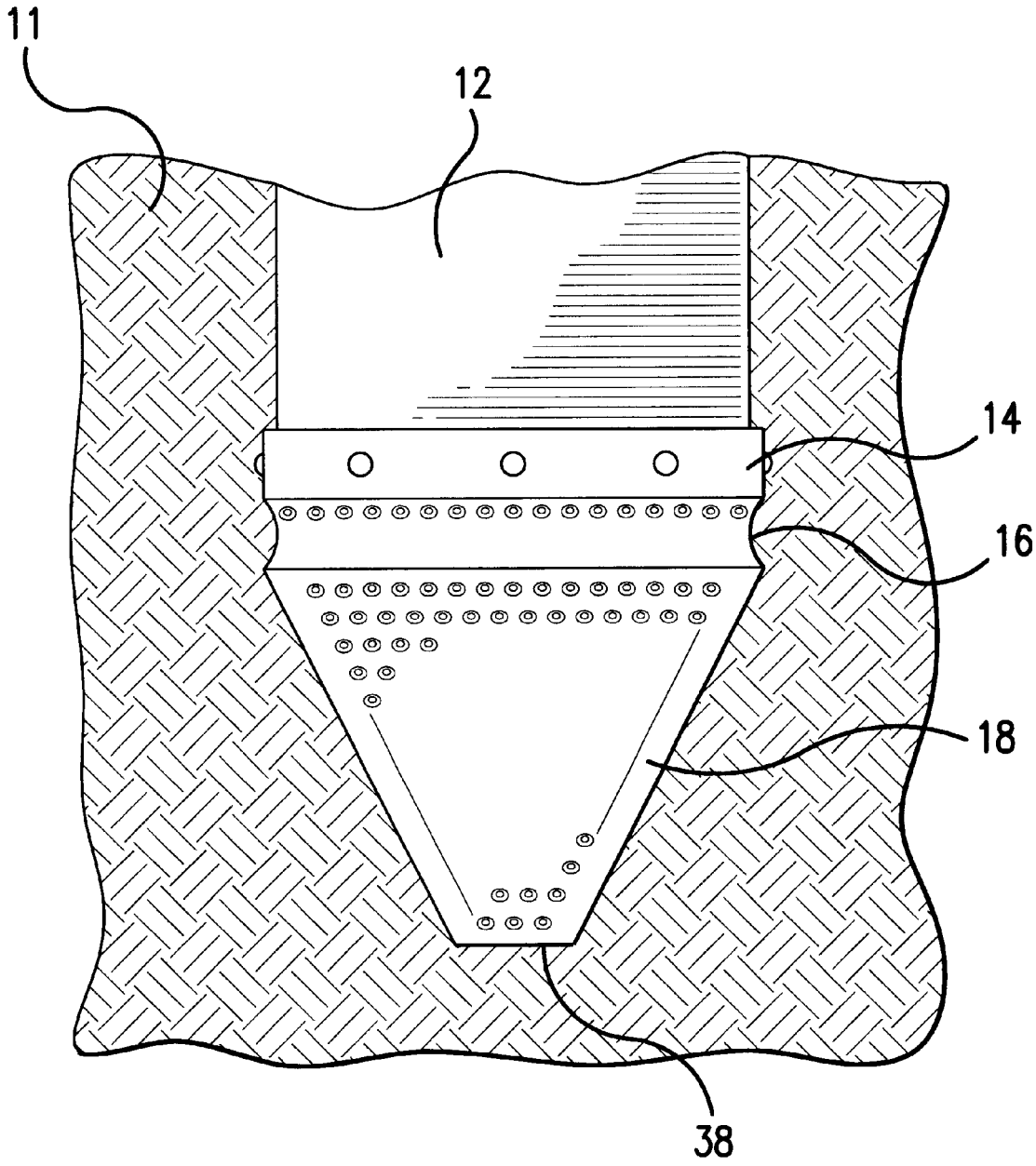
FIG. 7 is a side elevational view of the jet device according to FIG. 6, taken at line 7—7.

Referring to FIGS. 6 and 7, the water or other flowable substance is ejected from the device 10 into the surrounding ground material 11, loosening and softening the ground 11 and facilitating installation of the piling 12. As shown in FIG. 7, when the piling 12 is in place at the desired elevation, the device 10 remains in place permanently, or as long as the piling lasts, and the surrounding material 11 settles into place in the groove portion 16. The groove portion 16 thus helps to secure the piling 12 in the ground, even after installation.

In the preferred embodiment for a round piling or post, the flange portion 14 is generally cylindrical for closely fitting over the base of the piling or post, and the attachment means is a suitable number of nails 34 extending through the flange portion 14 into the piling 12 or post. The main body portion 18 is preferably substantially comprised of a polyvinylchloride ("PVC") material.

Figure 4:
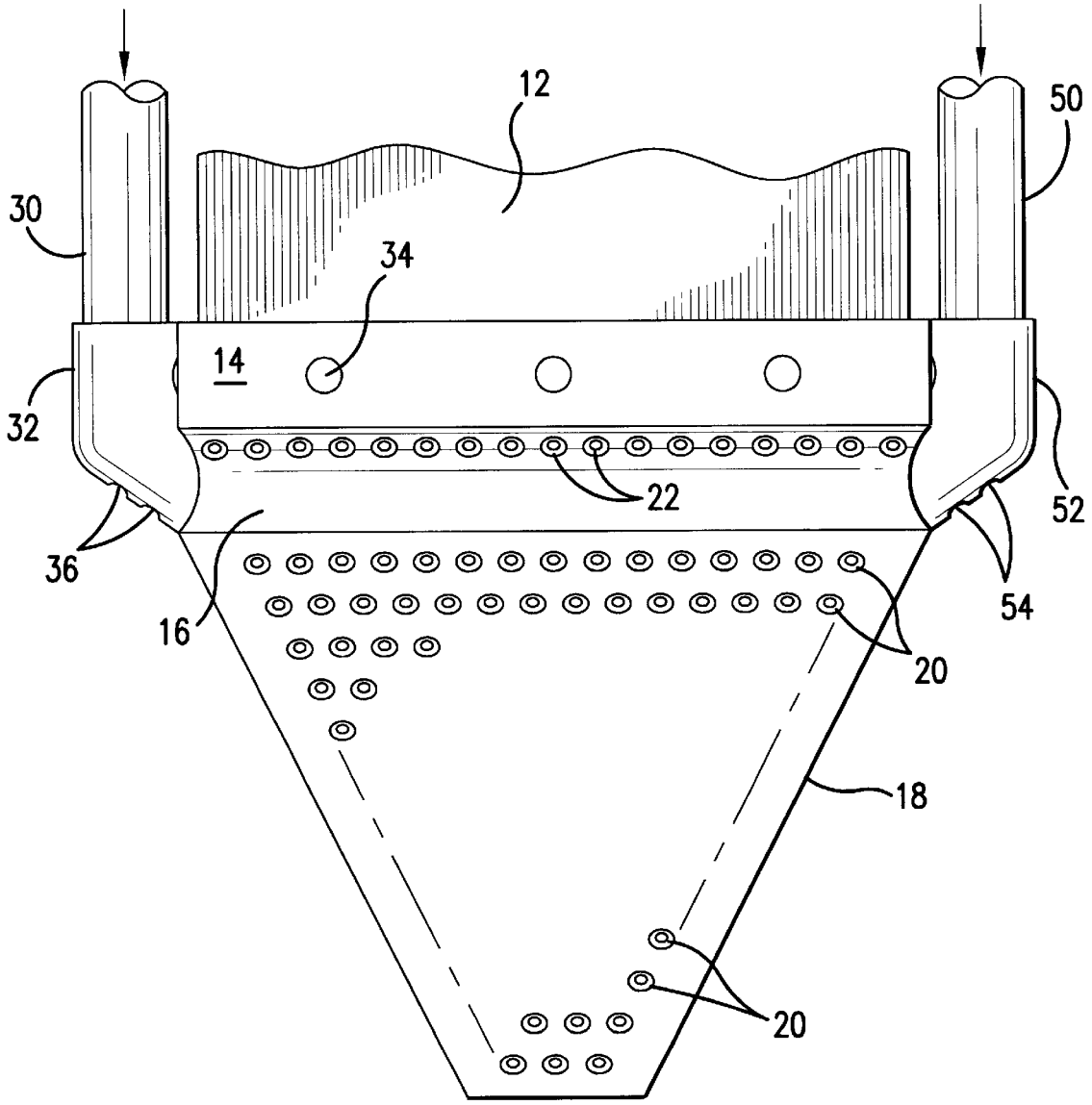
FIG. 4 is a front elevational view of a second embodiment of a jet device according to the present invention, with two lines.
Figure 5:
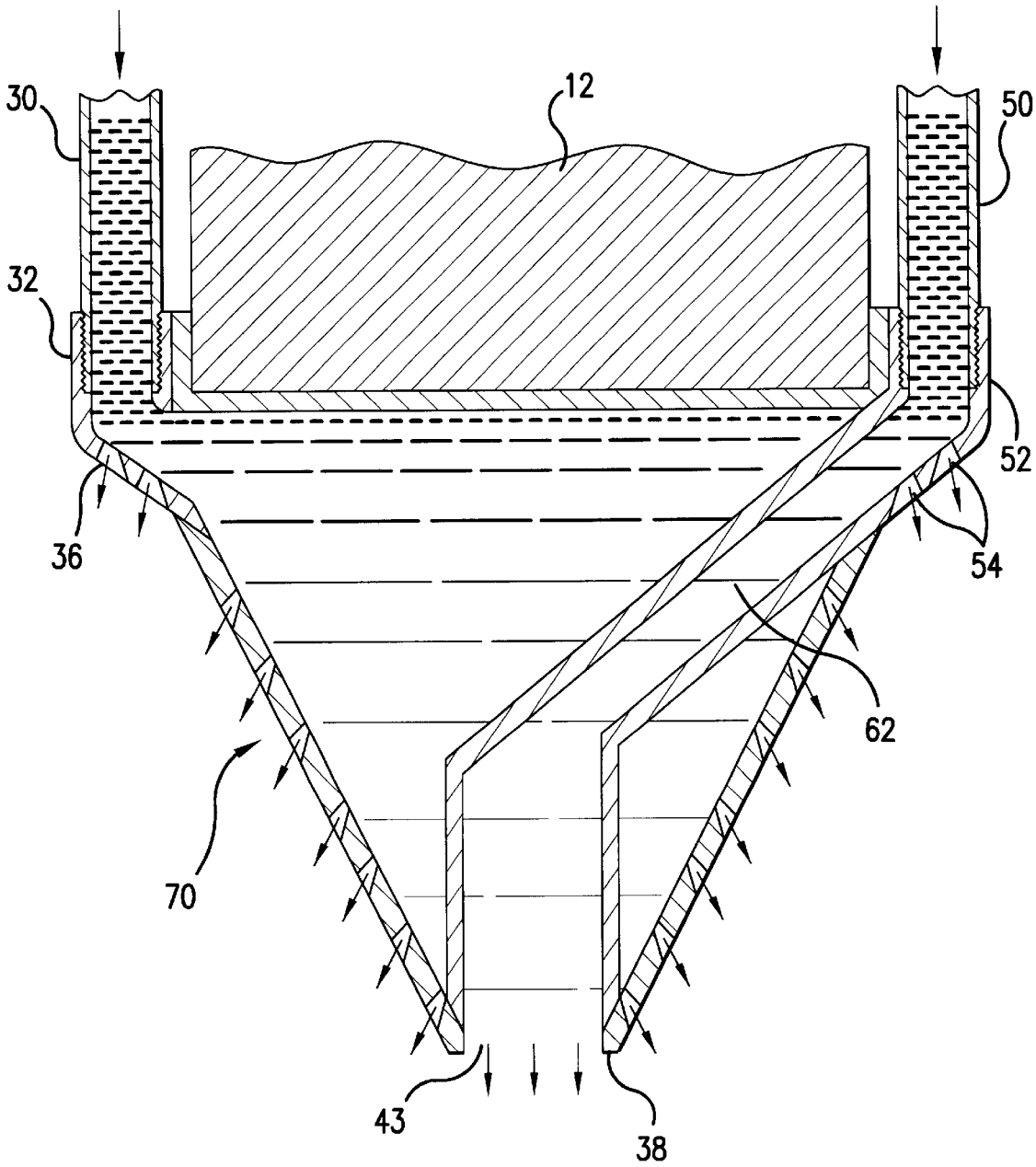
FIG. 5 is a sectional side view of the jet device according to FIG. 4.

Turning now to FIG. 4 and FIG. 5, in a second alternate embodiment, a second high pressure line 50 is attached to the jet head device 10 by means of a second shouldered fitting 52, which is configured in a manner similar to the first shouldered fitting 32. The second line 50 fits into the second fitting 52 and runs alongside of and parallel to the piling 12, but on the opposite side of the piling 12 from the first line 30. Like the first line fitting 32, the second fitting 52 is preferably perforated by two or more apertures 54. In this embodiment, the first line 30 is directed into the upper portion of the main body portion, while the second line 50 is connected by means of an extension 62 through the lower portion of the main body to the nose aperture 43. Thus, water, or another flowable substance, from the first high pressure line 30 flows into the main body portion 18 and is ejected through the perforations 36, 22, 20 in the fitting 32, groove portion 16, and main body portion 18, respectively. A different, flowable substance from the second high-pressure line 50 flows out through the aperture 43 in the nose 38.

Figure 2A:
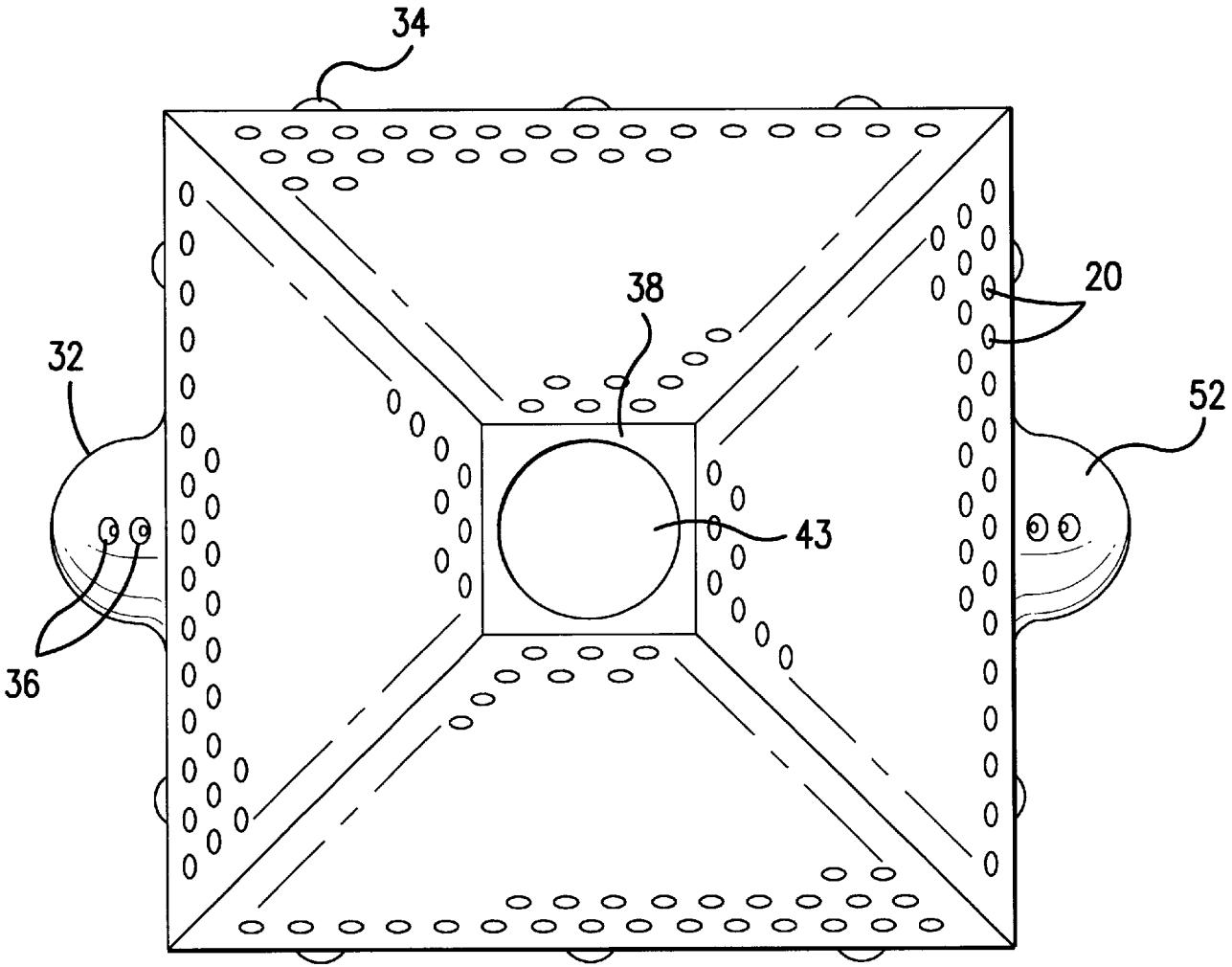
FIG. 2A is a bottom plan view of an alternate embodiment of a jet device according to FIG. 1.

The first, pyramidal embodiment of FIG. 2A also comprises two shouldered fittings 32, 52, or elbow joints, and a central aperture 43 in the nose 38.

Figure 8:
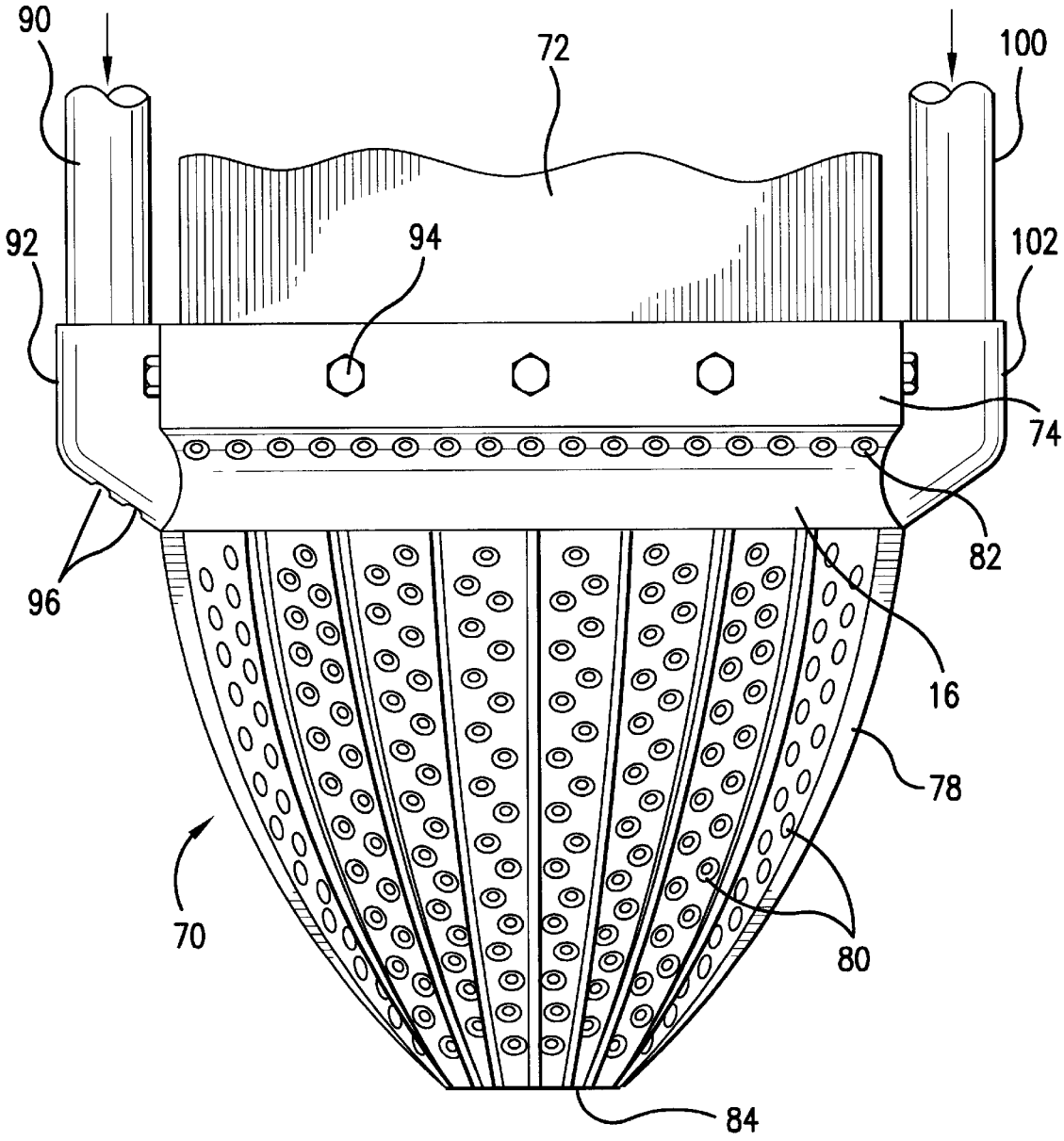
FIG. 8 is a front elevational view of a third embodiment of a jet device according to the present invention.
Figure 9:
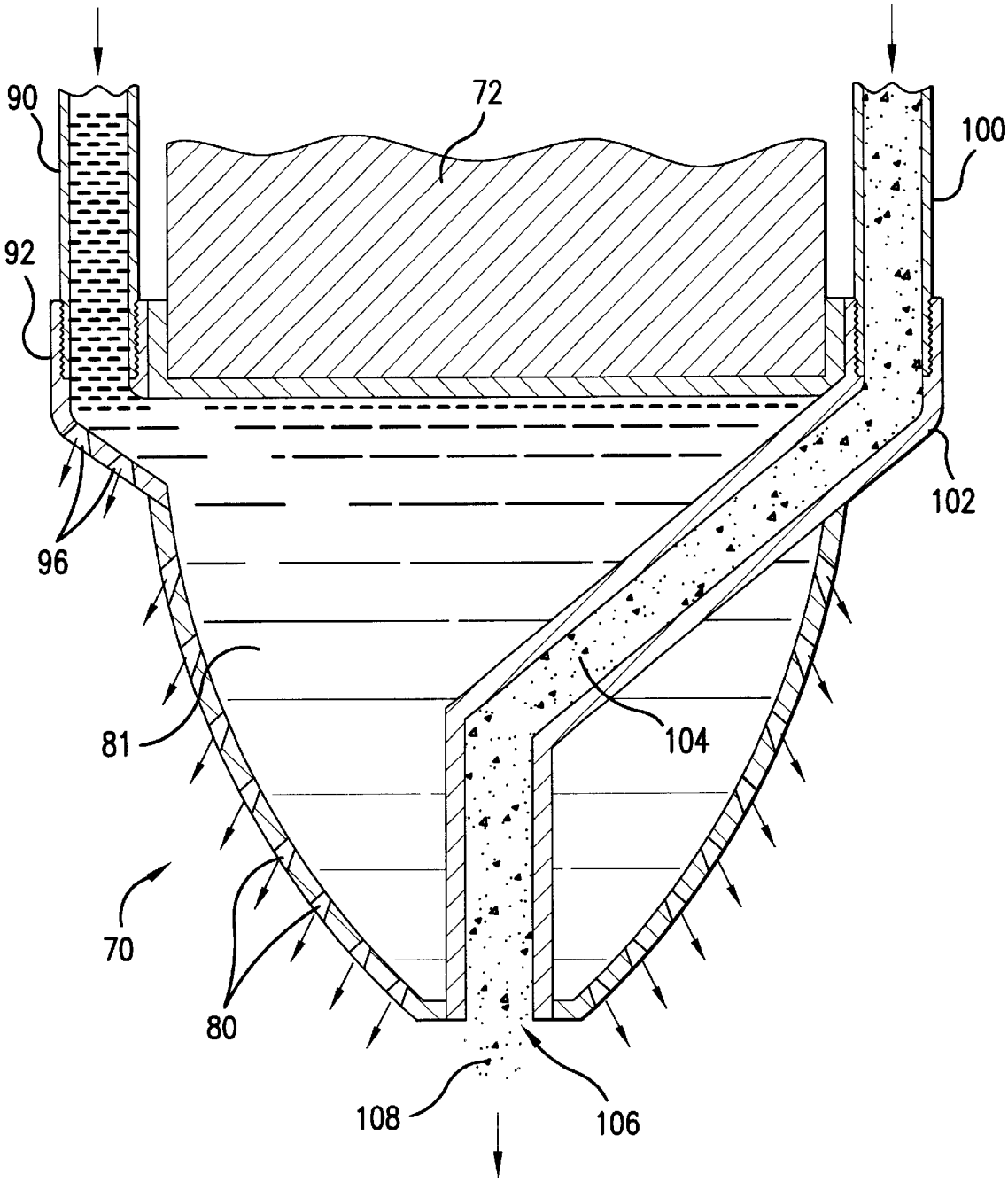
FIG. 9 is a sectional side view of the jet device according to FIG. 8.

Referring to FIG. 8 and FIG. 9, a third embodiment 70 of the device is equipped with a single high-pressure line 90 and a high velocity vacuum or concrete line 100. This embodiment is designed for heavy-duty uses, where it is desired to remove the water after it is pumped through the high-pressure line 90, or to inject concrete or some other fluid foundation mixture. This heavy duty device 70 is preferably constructed of a durable material such as molded, cast, or fabricated form steel. The flange portion 74 is fastened to the concrete piling 72 by means of bolts 94, or other heavy-duty methods. The two lines 90, 100 are joined via fittings 92, 102 to the groove portion 16, as in the previous embodiments, on opposite sides of the device, and the most recessed part of the groove portion is perforated with a line of spaced apart, same sized groove apertures 82. The sides of the main body portion 78 in the preferred embodiment shown in FIG. 8 and FIG. 9, are generally somewhat rounded in shape toward the circular, flattened nose 84, and are perforated with evenly spaced, directed flow apertures 80. Water is directed by the apertures 80 in a downward direction, so the water loosens the earth under the piling. This makes the job of sinking pilings faster, meaning that a dock or other project can be completed in less time.

As shown in FIG. 9, the high-pressure first line 90 is connected through the shouldered fitting 92 to the hollow interior 81 of the main body portion 78. The second line 100 is connected through a second shouldered fitting 102 by means of an angled extension 104 directly to an opening 106 in the nose 84 of the main body portion 78. The second line 100 can be used to pump concrete 108 out of the nose of the cap after the piling has been installed, as shown in FIG. 9.

Figure 11:
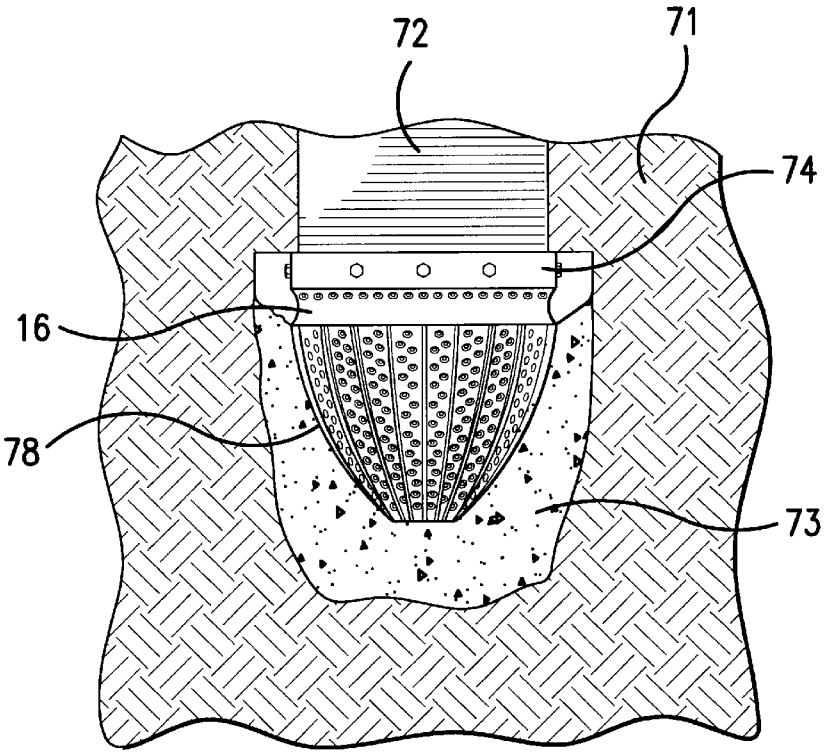
FIG. 11 is a side elevational view of the jet device according to FIG. 8, shown in the ground.
Figure 10:
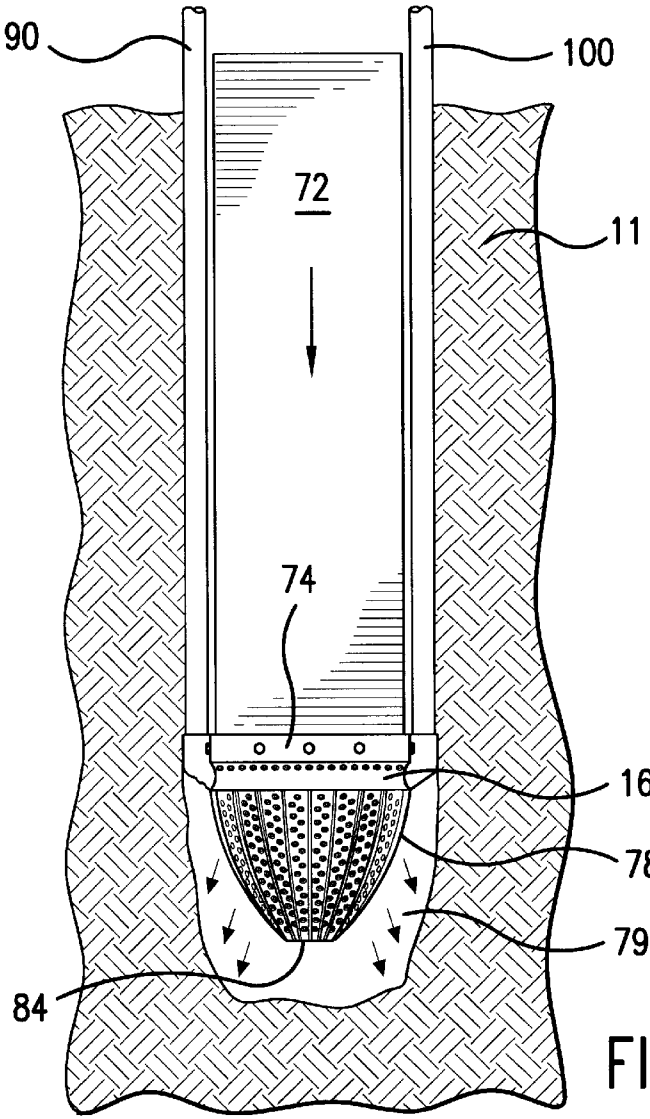
FIG. 10 is a front elevational view of the jet device according to FIG. 8, shown in the ground.

Referring to FIG. 10 and FIG. 11, water is pumped through the high-pressure line 90 and ejected from the heavy duty jetting device 70 through the apertures 80 in the main body portion 78, and the apertures 82 in the groove portion 76, into the surrounding ground 11. If it is desired to remove the water for reuse, disposal, or other purposes, the second line 100 can operate as a vacuum line. Once the vacuum pump on the surface is started, the water, along with dirt and any other particles in the water, is sucked up through the aperture 106 in the nose 84 through the extension 104 and up the second line 100. The water/dirt slurry is pulled up to the surface and properly disposed of. In an alternate use of this embodiment, water is ejected through the apertures 80, 82, as before. When the piling 72 has reached the desired depth, sand, mud, or sediment may be removed through the vacuum line 100, creating a chamber area 79 around the cap into which concrete can then be injected in the ground 11 through the same line 100, extension 104, and aperture 106, where it will form a foundation 73 around the piling 72. The arrows in FIG. 10 show the direction of flow of the water into the chamber area 79, and concrete particles in the foundation 73 are shown in FIG. 11.

Figure 12:
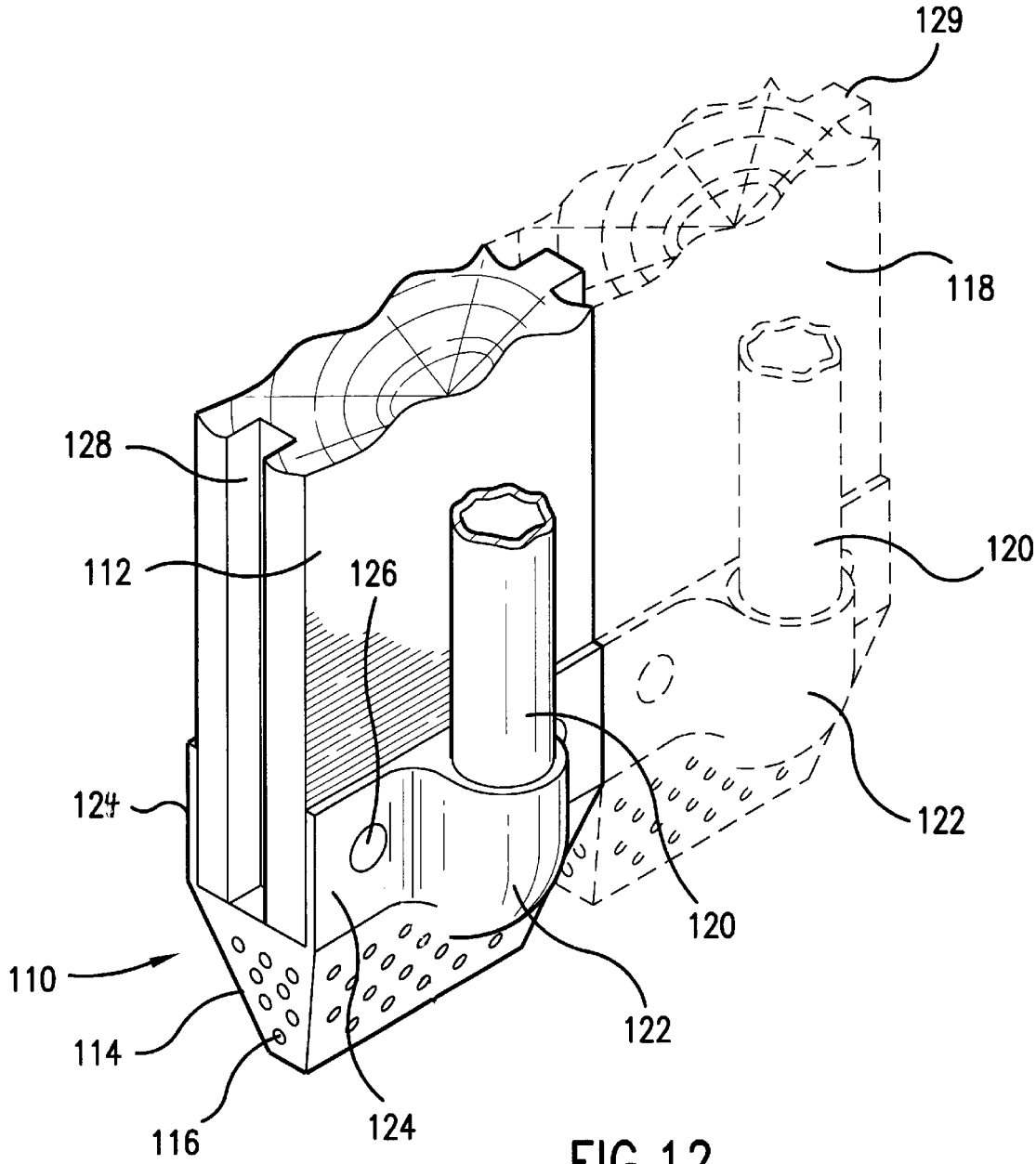
FIG. 12 is a front perspective view of an alternate embodiment of the jet device according to the present invention, for a tongue and groove bulkhead.

Turning to FIG. 12, a fourth alternate embodiment of the device 110 fits over the base of a tongue and groove bulkhead section 112. In this embodiment, the flange portion 124 takes a generally rectangular shape in cross-section, wherein the flange portion 124 has two long opposite matched sides, which are fastened by means of screws or nails 126 into the flat side of the bulkhead 112. The shorter sides of each rectangular flange portion 124 are open to allow joining of one bulkhead section 112 to the adjacent bulkhead section 118. The lower long sides of each flange portion are attached to the upper end of the main body portion. This embodiment preferably has no groove portion, as the flange portion 124 is directly connected to the main body portion 114, which takes the shape of a rectangular pyramid. The main body portion 114 is perforated on all sides with a number of evenly spaced apertures 116. The high-pressure line 120 feeds into a shouldered fitting 122 built into the flange portion 124 on one of the sides, so that water may be pumped into the main body portion 114 and ejected through the apertures 116, as in other embodiments.

Turning to FIG. 13 and FIG. 14, in still another embodiment, the device 130 may be fitted to a circular piling 132. In this fifth embodiment, the device 130 is cone-shaped rather than pyramid-shaped, so that the flange portion 134 is circular and wraps around the post 132, to which it is secured by nails 34 or screws (see FIG. 14). The groove portion 136 below the flange portion 134 is also circular, as is the main body portion 138. The groove portion 136 and main body portion 138 are perforated by apertures 140, 142, 144, as in the other embodiments, through which water is again ejected from a high-pressure line 150, fitted in generally the same way to a shouldered fitting 152, as shown in FIG. 13, which opens through the groove portion 136 into the hollow interior of the main body portion 138.

Figure 15:
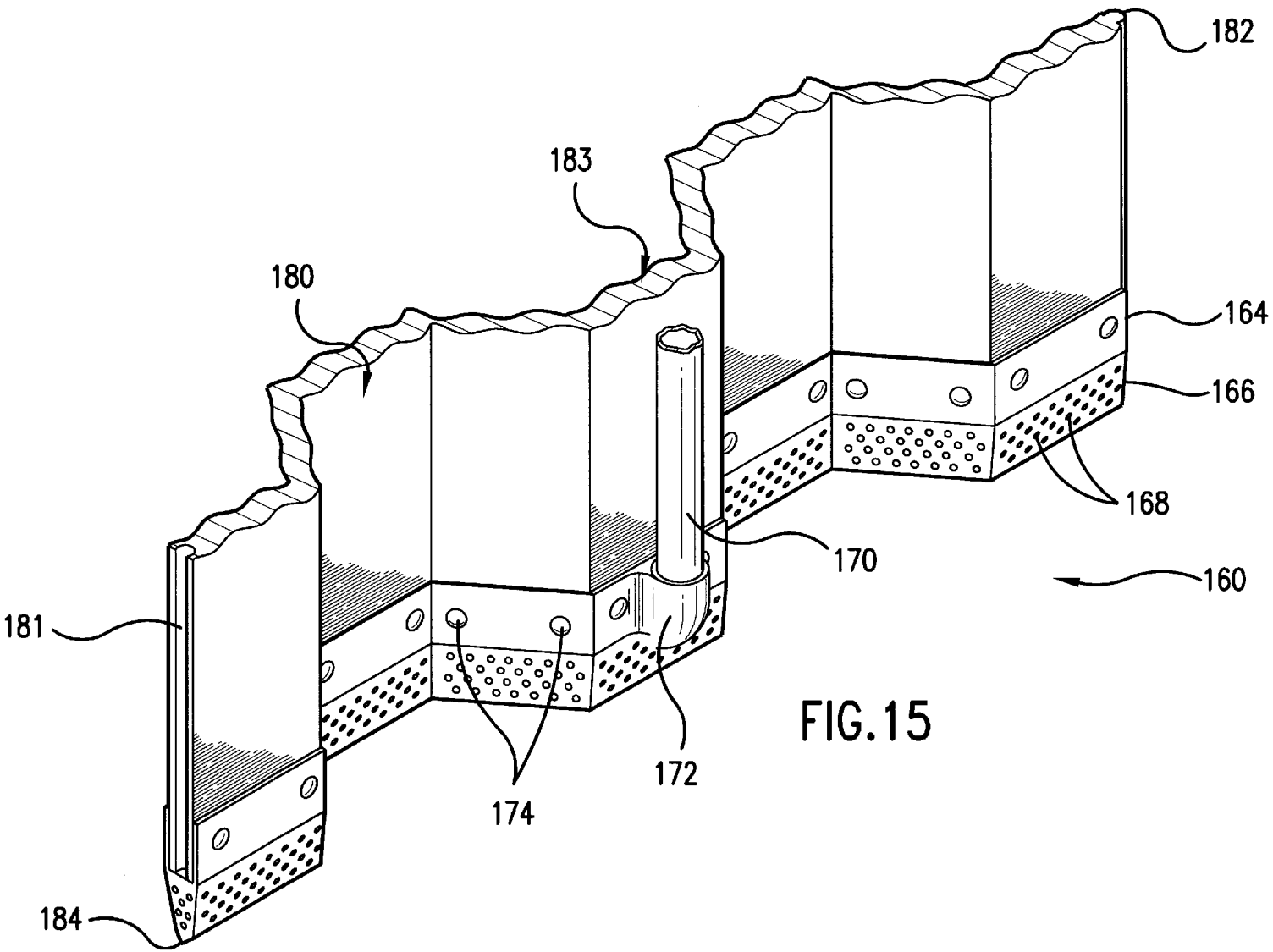
FIG. 15 is a front perspective view of a jet device according to the present invention, for a corrugated bulkhead.

Referring to FIG. 15, in a sixth embodiment for sinking a bulkhead section, the device 160 may be manufactured to conform to the shape of corrugated bulkhead material 162. In FIG. 12, two devices 110 are shown on two adjacent bulkhead sections. In FIG. 15, a single long device 160 extends along the base of a bulkhead section 180. In this embodiment, the device 160 may alternatively be made of numerous continuous segments, each of which takes the rectangular shape of the embodiment shown in FIG. 12. As shown in FIG. 15, the device 160 is bent at alternating 45-degree angles, and the pattern is repeated for the length of the bulkhead section, so that the device 160 mirrors and fits over the base of the bulkhead section 180. The sheet pile, or bulkhead section 180, is shown in FIG. 15 with a groove 181 at one end, and a tongue 182 at an opposite end. Once one bulkhead section 180 is installed, a second bulkhead section can be added at either end of the installed section by fitting the tongue of the new bulkhead section into the groove of the installed section, or vice versa.

As in the embodiment shown in FIG. 12, the groove portion here is absent, and the flange portion 164 is similarly mounted onto the bulkhead section 180 by screws or projections 174. The projections 174 are raised surfaces which are spaced apart along an inside wall of the flange portion 164. The perforations 174 clip onto the sheet pile, or bulkhead section, to hold the device on the section as it is being installed. The sheet pile is preferably made of polyvinylchloride ("PVC"). A high-pressure line 170 is similarly joined to one side of the flange portion 174 at a shouldered fitting 172 at a middle segment 183 of the bulkhead section. The fitting 172 directs incoming water to the main body portion 166, from which it is ejected through numerous apertures 168. Again, the water softens the ground and the jetting action physically moves the earth away from the base of the bulkhead section, which facilitates sinking of the bulkhead section.

Thus, an embodiment 160 of the present invention for sinking a bulkhead section 180, as shown in FIG. 15, comprises:

(a) a cap comprising a generally rectangular-shaped, perforated main body portion 166 having a length and width generally equal to the length and width, respectively, of the bulkhead section 180; the main body portion 166 having a hollow interior, and a pointed nose 184; the device further comprising a flange portion 164 with two substantially matching sides extending in a vertical direction from the main body portion 166;

(b) attachment means, preferably projections 174, on the flange portion 164 for attaching the device 160 to a base of the bulkhead section 180; and (c) a threaded fitting 172 on the device for receiving a detachable, generally vertical line 170 for conducting a liquid or air into the main body portion 166. Preferably, the bulkhead section 180 is tongue in groove sheet pile, as shown in FIG. 15, and the attachment means is a plurality of the perforations 174 on an inside face of the flange portion.

The jetting device 160 preferably further comprises:

(d) at least one line 170 for conducting the liquid or air, a threaded end of the line being screwed into the fitting 172 and leading to the hollow interior of the main body section, an opposite end of the line being connected to a supply of the liquid or air, the line 170 extending in a generally vertical direction adjacent to the bulkhead section 180.

In each embodiment, the cap or jet head is inexpensive and simply remains on the piling or bulkhead after installation in the ground.

Also included herein is a method for installing a piling, post, or bulkhead section, comprising the steps of:

(a) affixing a conical, pyramidal, or pointed rectangular cap to the round, square, or rectangular shaped base of the piling, post, or bulkhead section to be installed, the cap being perforated;

(b) removably connecting a pressurized water line or vacuum line to the cap;

(c) suspending the piling, post, or bulkhead section in a generally vertical position for installation;

(d) pumping water to the cap or pulling a vacuum in the line while sinking the piling, post, or bulkhead section down into the ground; and (e) disconnecting the water or vacuum line from the cap once the piling, post, or bulkhead section is installed.

The method preferably further comprises the steps of:

(b2) affixing a second line to an opposite side of the cap from the water or vacuum line, and (f) pumping a flowable concrete through the second line into the cap once the piling, post, or bulkhead has been installed.

The method preferably further comprises the steps of:

(b2) as part of step (b), affixing both the first, water line, and a second, vacuum line to opposite sides of the upper section of the cap;

(d2) as part of step (d), pumping water into the cap; and periodically operating a vacuum pump to pull a vacuum in the second line for removing water and dirt from the cap; and (e2) as part of step (e), disconnecting both of the lines from the cap once the piling, post, or bulkhead section has been installed.

From the foregoing it can be realized that the described device of the present invention may be easily and conveniently utilized as a means of installing piles or pilings in numerous applications, including fence posts, dock pilings, bulkheads, retaining walls, housing stilts, mobile home and modular home tie downs, and structural foundations for buildings, bridges, and overpasses. The jet head allows a more adequate and efficient means of installation of pilings and foundation support systems than current hammering systems. Using water to sink pilings will reduce the amount o installation time with less stress to piling material, ground, and sub-ground structures. This would reduce or eliminate the noise produced by crane-operated hammers in populated areas. The jet head also has the capability of installing footing or foundation material directly below the piling or support structure using hydraulic cement or other similar materials.

While preferred embodiments of the invention have been described using specific terms, this description is for illustrative purposes only. It is to be understood that any dimensions given herein are illustrative, and are not meant to be limiting. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A jetting device for installing a piling or post, the device comprising:

(a) a cap comprising a generally conical or pyramidal shaped main body portion, and an upper flange portion for closely fitting over a base of the piling or post, the flange portion extending upwardly in a generally vertical direction from the main body portion, the main body portion comprising a hollow interior and a plurality of perforations;

(b) attachment means for attaching the flange portion of the cap to the base of the piling or post; and (c) a threaded fitting for receiving a detachable, generally vertical line for conducting a liquid or air into the cap, the fitting being in an upper section of the main body portion below the flange portion.

2. A device according to claim 1, wherein the main body portion comprises a groove portion in its upper section, the groove portion extending parallel and adjacent to the flange portion, the flange portion extending around the circumference of the piling or post.

3. A device according to claim 2, wherein the flange portion is generally cylindrical for closely fitting over the base of the piling or post, and the attachment means is a plurality of nails extending through the flange portion into the piling or post.

4. A device according to claim 1, further comprising:

(d) at least one detachable line for conducting liquids or air, a threaded lower end of the at least one line being closely connectable to the correspondingly threaded fitting, the at least one line extending in a generally vertical direction generally parallel to the longitudinal axis of the piling or post; and (e) at least one pump for pumping the liquid or air up or down the at least one line, the at least one pump being coupled to an opposite, upper end of the at least one line; and (f) at least one supply source for the liquids, the at least one liquid supply source being connected to the upper end of the at least one line.

5. A device according to claim 4, wherein the fitting is a threaded, shouldered fitting for connecting the correspondingly threaded lower end of the line to a groove portion of the main body portion.

6. A device according to claim 5, wherein the cap is substantially comprised of a polyvinylchloride material.

7. A device according to claim 5, wherein there are two of the lines for conducting liquid or air, and two of the at least one pump, with one of the two pumps being operably connected to each one of the two lines, a second one of the two lines being connected to the groove portion opposite to a point of entry of a first one of the two lines.

8. A device according to claim 7, wherein the cap is substantially comprised of a heavy duty steel material.

9. A device according to claim 8, wherein the attachment means is a plurality of bolts extending through the flange portion into the piling or post.

10. A device according to claim 8, wherein the attachment means are permanent, and the cap remains in place on the piling or post after installation of the piling or post.

11. A device according to claim 7, wherein the first line is a pressurized water injection line, a first one of the at least one liquid supply source is a water source, and a first one of the at least one pump is a water pump for pumping water down the at least one line to the cap.

12. A device according to claim 11, wherein the second line is a concrete injection line, and a second one of the at least one liquid supply source is a tank of flowable concrete.

13. A device according to claim 12, wherein the second line extends through the cap to a main aperture in a nose portion of the main body portion, the aperture having the same diameter as the inside diameter of the second line.

14. A device according to claim 5, wherein a second one of the at least one lines is a vacuum line, and a second one of the at least one pumps is a vacuum pump.

15. A device according to claim 5, wherein the flange portion is generally square in shape to accommodate a piling or post that is square in shape.

16. A device according to claim 15, wherein the main body portion has the pyramidal shape, and comprises a flattened, perforated nose portion at a lower end of the main body portion.

17. A device for installing a bulkhead section, the device comprising:

(a) a cap comprising a generally rectangular-shaped, perforated main body portion having a length and width generally equal to the length and width, respectively, of the bulkhead section; the main body portion having a hollow interior, and a pointed nose; the device further comprising a flange portion with two substantially matching sides extending in a vertical direction from the main body portion;

(b) attachment means on the flange portion for attaching the device to a base of the bulkhead section; and (c) a threaded fitting on the device for receiving a detachable, generally vertical line for conducting a liquid or air into the main body portion.

18. A device according to claim 17, further comprising:

(d) at least one line for conducting the liquid or air, a threaded end of the at least one line being screwed into the fitting and leading to the hollow interior of the main body portion, an opposite end of the at least one line being connected to a supply of the liquid or air, the at least one line extending in a generally vertical direction adjacent to the bulkhead section.

19. A device according to claim 18, further comprising at least one pump for pumping the liquid or air up or down the line, the at least one pump coupled to an opposite, upper end of the line.

20. A device according to claim 17, wherein the bulkhead section is a sheet pile, and the attachment means is a plurality of projections on an inside face of the flange portion.

21. A method for installing a piling, post, or bulkhead section, comprising the steps of:

(a) affixing a conical, pyramidal, or pointed rectangular cap to the round, square, or rectangular shaped base of the piling, post, or bulkhead section to be installed, the cap being perforated;

(b) removably connecting a pressurized water line or vacuum line to the cap;

(b2) affixing a second line to an opposite side of the cap from the water or vacuum line;

(c) suspending the piling, post, or bulkhead section in a generally vertical position for installation;

(d) pumping water to the cap or pulling a vacuum in the line while sinking the piling, post, or bulkhead section down into the ground;

(e) disconnecting the water or vacuum line from the cap once the piling, post, or bulkhead section is installed; and (f) pumping a flowable concrete through the second line into the cap once the piling, post, or bulkhead has been installed.

22. A method for installing a piling, post, or bulkhead section, comprising the steps of:

(a) affixing a conical, pyramidal, or pointed rectangular cap to the round, square, or rectangular shaped base of the piling, post, or bulkhead section to be installed, the cap being perforated;

(b) removably connecting a pressurized water line or vacuum line to the cap;

(b2) as part of step (b), affixing both the first, water line, and a second, vacuum line to opposite sides of the upper section of the cap;

(c) suspending the piling, post, or bulkhead section in a generally vertical position for installation;

(d) pumping water to the cap or pulling a vacuum in the line while sinking the piling, post, or bulkhead section down into the ground;

(d2) as part of step (d), pumping water into the cap; and periodically operating a vacuum pump to pull a vacuum in the second line for removing water and dirt from the cap;

(e) disconnecting the water or vacuum line from the cap once the piling, post, or bulkhead section is installed; and (e2) as part of step (e), disconnecting both of the lines from the cap once the piling, post, or bulkhead section has been installed.

* * * * *